US005193827A

United States Patent [19]

Olson

[11] Patent Number: 5,193,827

[45] Date of Patent: Mar. 16, 1993

[54] CONVERTIBLE IN-LINE ROLLER SKATES

[75] Inventor: Scott B. Olson, Bloomington, Minn.

[73] Assignee: O.S. Designs, Inc., Bloomington, Minn.

[21] Appl. No.: 868,457

[22] Filed: Apr. 14, 1992

[51] Int. Cl.[5] ..... A63C 1/20

[52] U.S. Cl. ..... 280/7.13; 280/11.26; 280/11.3; 280/11.22

[58] Field of Search ..... 280/7.13, 7.14, 11.22, 280/11.23, 11.3

[56] References Cited

U.S. PATENT DOCUMENTS

| | | | |
|---|---|---|---|
| 28,509 | 5/1860 | Shaler | 280/11.22 |
| 97,075 | 11/1809 | Gibson | 280/7.13 |
| 441,841 | 12/1890 | Hatschek | 280/11.3 |
| 480,610 | 8/1892 | Nielson | 280/11.22 |
| 916,289 | 3/1909 | Fitzgerald | 280/11.22 |
| 938,168 | 10/1909 | Nolan | 280/7.13 |
| 954,933 | 4/1910 | Peters | 280/11.22 |
| 1,260,692 | 3/1918 | Madsen | 280/11.22 |
| 1,268,385 | 6/1918 | Paulsen | 280/11.22 |
| 1,428,210 | 9/1922 | Boche | 280/11.22 |
| 1,527,840 | 2/1925 | Chomin | 280/11.22 |
| 1,530,211 | 3/1925 | Siemnash | 280/7.13 |
| 1,572,567 | 2/1926 | Skorka | 280/11.22 |
| 1,604,643 | 10/1926 | Harlowe | 280/11.22 |
| 1,728,629 | 9/1929 | Sahlmann | 280/11.22 |
| 1,801,205 | 4/1931 | Mirick | 280/11.22 |
| 1,835,446 | 12/1931 | Tracey | 280/11.22 |
| 1,868,548 | 7/1932 | Turner | 280/11.22 |
| 2,019,738 | 11/1935 | Smith | 280/11.28 |
| 2,068,916 | 7/1936 | Bentzlin | 280/11.22 |
| 2,220,557 | 11/1940 | User | 280/11.22 |
| 2,244,719 | 6/1941 | Mansfield | 280/11.3 |
| 2,377,366 | 6/1945 | Paystrup | 280/11.23 |
| 2,412,290 | 12/1946 | Rieske | 280/11.22 |
| 2,548,391 | 4/1951 | Petrime | 280/7.13 |
| 2,644,692 | 7/1953 | Kahlert | 280/11.22 |
| 3,387,852 | 6/1968 | DeSarro | 280/11.2 |
| 3,880,441 | 4/1975 | Silver | 280/11.22 |
| 3,901,520 | 8/1975 | McMahan | 280/7.13 |
| 3,918,729 | 11/1975 | Peters | 280/7.13 |
| 4,108,450 | 8/1978 | Cote | 280/7.13 |
| 4,114,295 | 9/1978 | Schaefer | 36/100 |
| 4,323,259 | 4/1982 | Boudreau | 280/7.13 |
| 4,351,536 | 9/1982 | Sandino | 280/7.13 |
| 4,353,562 | 10/1982 | Teifenthal | 280/7.13 |
| 4,382,605 | 5/1983 | Hegna | 280/11.22 |
| 4,492,385 | 1/1985 | Olson | 280/7.13 |
| 4,666,169 | 5/1987 | Hamill et al. | 280/11.23 |
| 4,699,390 | 10/1987 | Cote | 280/11.23 |
| 4,932,675 | 6/1990 | Olson et al. | 280/7.13 |
| 4,988,122 | 1/1991 | Saunders | 280/841 |

*Primary Examiner*—David M. Mitchell
*Attorney, Agent, or Firm*—Haugen and Nikolai

[57] ABSTRACT

An improved skate assembly which permits interchange of ice blades and in-like rollers. The arrangement provides for such interchange through utilization of a rotatable cam which is utilized to couple the blade support to the toe and/or heel of the boot. Also, an interlocking notch/projection may be employed to achieve secure mounting of the blade support subassembly to the boot.

6 Claims, 5 Drawing Sheets

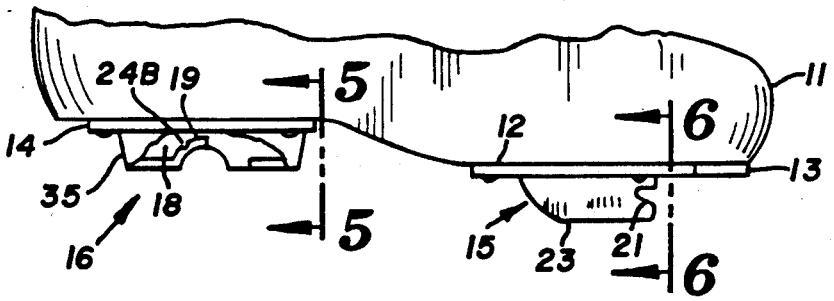
FIG.3
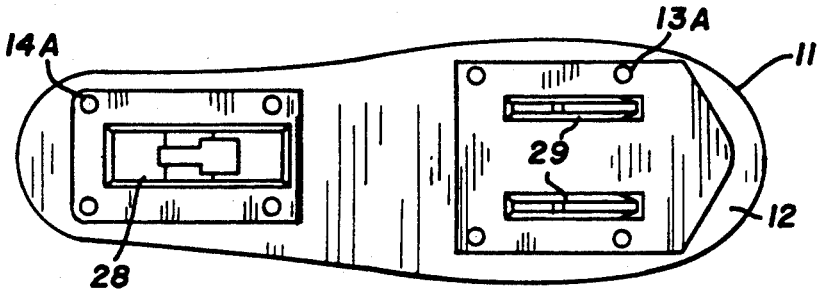
FIG.4
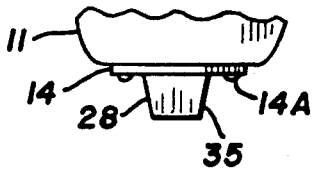
FIG.5
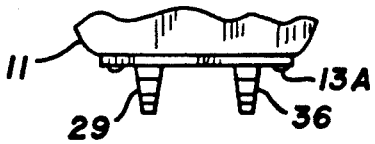
FIG.6
FIG.7
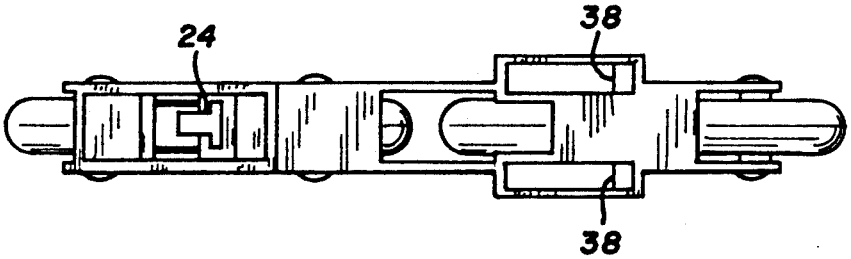
FIG.8
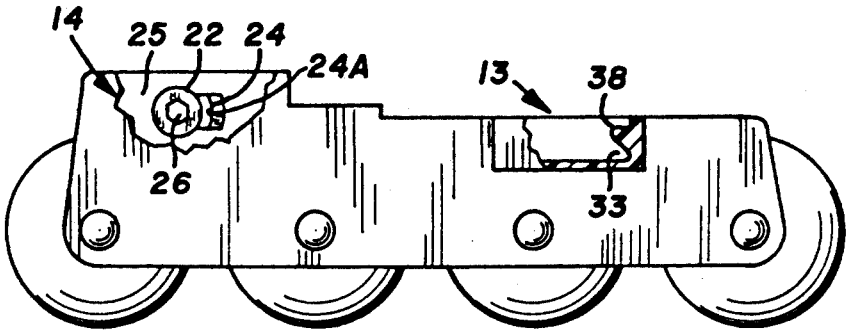

CONVERTIBLE IN-LINE ROLLER SKATES

BACKGROUND OF THE INVENTION

The present invention relates to an improved skate assembly, and more particularly to an improved skate assembly which permits rapid, secure, and convenient interchange between ice blades and in-line rollers. The arrangement is designed to provide rigid, solid and secure attachment between the shoe and the blade element, regardless of whether the blade is an ice blade or an in-line roller frame. As a further feature of the invention, roller frames are adjustable in the length dimension to accommodate more than one shoe size.

Skates having interchangeable blades have been known in the past. These devices, having interchangeable features, have typically required extensive and/or cumbersome effort in order to accomplish and/or achieve the change. Furthermore, while utilization of one size blade to be accommodated on different shoe sizes has been accomplished with ice blades, such a feature has been achieved only with a certain amount of difficulty with rollers, particularly in-line rollers. The arrangement of the present invention, in addition to providing a secure and sound coupling between the shoe and the surface blade support member, also provides a means for adjusting the length of the in-line roller support frame so as to permit the utilization of a limited number of blade designs and manufactured lengths for accommodating a variety of shoe sizes. Such an arrangement permits the user to achieve a better balance along with a blade availability which can accommodate a variety of different preferences with respect to blade design, configuration, wheel count, and the like.

A common disadvantage in the utilization of interchangeable blades is that of achieving a firm attachment between the shoe and the blade frame. Specifically, it has been known that any looseness or play in the attachment can contribute to unsatisfactory performance The present arrangement, by contrast, provides a firm, sound, and otherwise appropriate means for achieving secure releasable attachment between the shoe and the blade frame, with the in-line roller frame being designed to provide an adjustable length feature as well. Additionally, the design of the attachment pedestal secured to the shoe portion is at least partially in the form of an inverted truncated pyramid, thereby enhancing the stability and rigidity of the coupling arrangement.

SUMMARY OF THE INVENTION

Briefly, in accordance with the present invention, a skate assembly is provided which is designed for rapid and secure interchange of the surface blade support, whether an ice blade or an in-line roller assembly. The skate assembly includes a shoe having a sole plate and toe and heel attachment pads secured to the plate, with a surface blade coupling means provided in a recessed zone of the toe and heel attachment. A cooperating and complementary coupling means is, of course, secured within the blade assembly in order to achieve and accomplish the interchangeable feature. The skate assembly further includes a blade support subassembly with a frame having the surface contact member secured to the base thereof, and with a blade support anchoring cam ramp in oppositely disposed relationship to the surface blade support. The frame means includes toe and heel pad receiving cavities, both of which are designed to firmly receive and retain the pads in firm but releasable disposition therewithin. At least one rotatable camming ramp or rail is provided in the assembly with a retaining notch formed therein, with the camming ramp or rail being rotatable about a camming axis, and being arranged to mate with a complementary and cooperating anchoring flange members secured to and disposed within at least one of the attachment pads, normally the heel pad. When a single camming rail or ramp arrangement is employed, the other attachment means is preferably in the form of a stationary camming ramp, with a single rod member or the like being held in place within the camming ramp or camming rail. Both heel and toe attachment pads include complementary pyramidal shaped elements so as to more securely retain the members together, even after long periods of extensive uses. If desired, the in-line roller member may be adjustable in its length dimension, thereby enabling a single in-line roller frame to accommodate a variety of shoe sizes without sacrificing balance and performance for the user.

Therefore, it is a primary object of the present invention to provide an improved skate assembly which provides interchangeability between an ice blade and an in-line roller, with the interchangeability feature being accomplished by a coupling operation which provides relative movement along vertical axes.

It is yet a further object of the present invention to provide an improved interchangeable skate assembly which utilizes cooperating camming ramps or camming rails for achieving rigid attachment and interchangeability between blades, including ice blades and in-line rollers, and including, when desired, in-line rollers with length adjustability to accommodate varying shoe sizes.

Other and further objects of the present invention will become apparent to those skilled in the art upon a study of the following specification, appended claims, and accompanying drawings.

IN THE DRAWINGS

FIG. 3 is a partial vertical sectional view taken along the line and in the direction of the arrows 3—3 of FIG. 2;

FIG. 4 is a bottom plan view of the shoe portion and illustrating the details of the attachment means;

FIG. 5 is a partial rear view of a portion of the shoe assembly, with a portion of the upper shoe being cut away, with FIG. 5 being taken along the line and in the direction of the arrows 5—5 of FIG. 3, and illustrating the detail of the heel attachment means;

FIG. 6 is a partial front elevational view of a portion of the shoe, taken along the line and in the direction of the arrows 6—6 of FIG. 3, and illustrating the camming rails;

FIG. 7 is a top plan view of the in-line wheel assembly or wheel carrier;

FIG. 8 is a side elevational view, partially in section, and showing the cam profile and notch engagement ramp, with the shoe portion being removed;

DESCRIPTION OF THE PREFERRED EMBODIMENT

Figure 1:
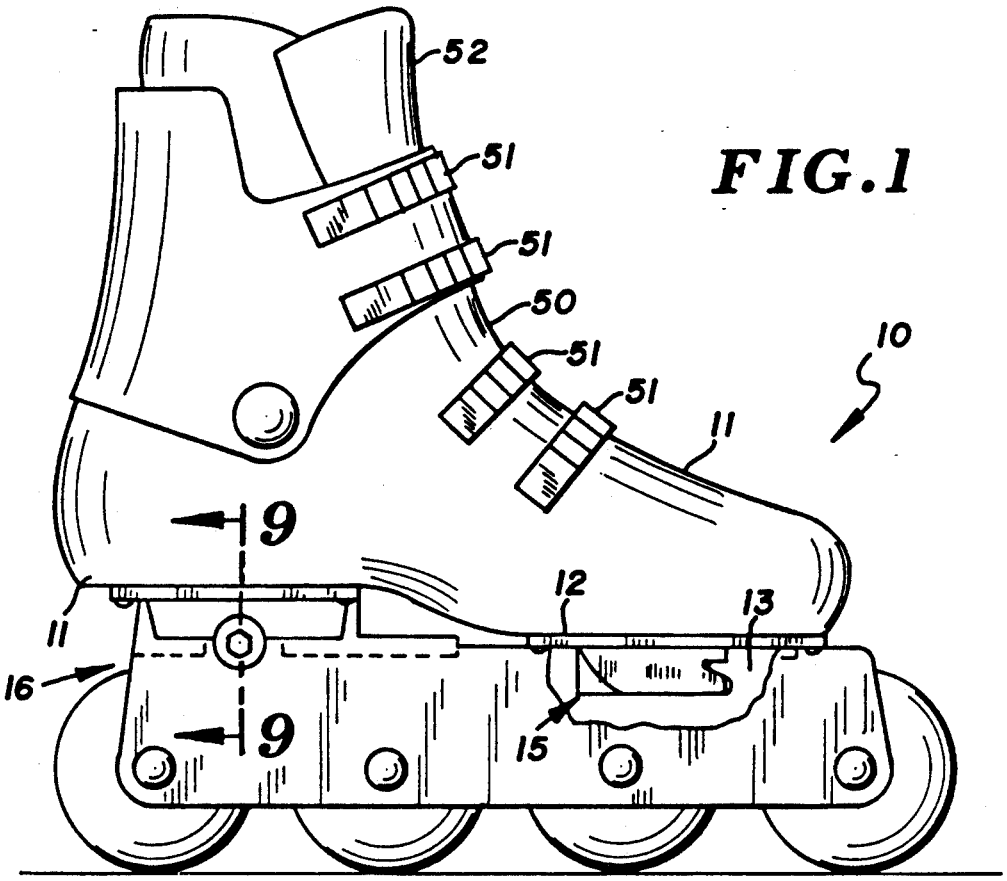
FIG. 1 is a side elevational view of a skate assembly in accordance with the present invention, and illustrating the assembly with an in-line roller member securely held in detachable relationship therewith.
Figure 2:
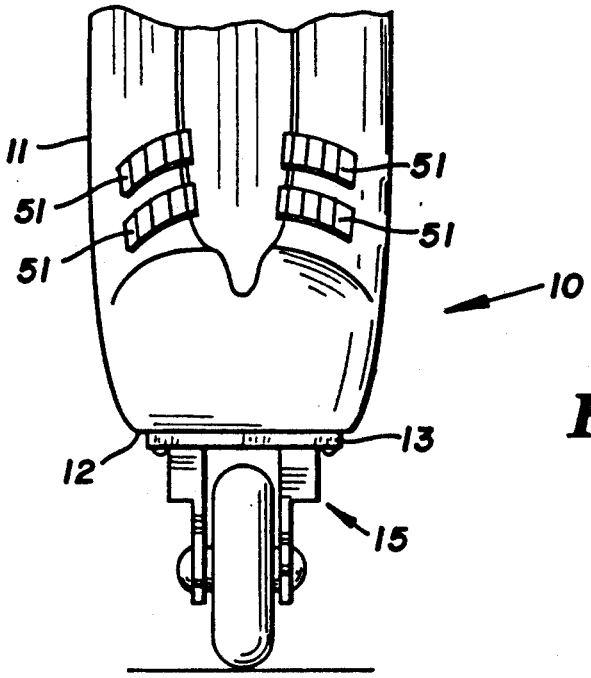
FIG. 2 is a front elevational view, partially broken away, and illustrating the manner in which the blade support is attached to the shoe.

In accordance with the preferred modification of the present invention, and with particular attention being directed to FIGS. 1-4 of the drawings, the skate assembly generally designated 10 comprises a shoe body 11 having a sole plate 12 secured thereto, with toe attachment 13 and heel attachment 14 being secured to the sole plate 12. Coupling means such as rivets are provided for securing a wearer's surface blade support subassembly as at 13A and 14A for attachment to the shoe, with the coupling means per se being shown generally at 15 and 16. In the view of FIG. 1, these coupling means are shown partially in phantom and partially in section, and will be described more fully hereinafter. With continued attention being directed to FIGS. 3 and 4, it will be observed that the heel attachment pads 14 includes a recessed zone as at 18, with this recessed zone containing a cam ramp or cam holding surface as at 19 molded into the attachment pad 13. It will be noted that the details of the camming rail for the to includes a retaining notch as at 21, and a flat wear surface as at 23. This arrangement will be described more fully hereinafter.

The shoe 11, as illustrated above, is designed of stable and utilitarian material. The shoe includes the base portion and instep area as at 50, together with coupling or closure members 51—51. Closure members are conventionally utilized in the art, and capture and otherwise retain tongue 52 in position for providing comfort to the user.

With attention being directed to FIGS. 7, 8, 9 and 10 of the drawings, it may be seen that the coupling means for securing the heel blade support subassembly to the shoe includes complementary rotatable cam member 24 which is coupled to the heel attachment member 25. Rotatable cam 24 is designed to pivot about the axis of coupling bolt 25, and since it is eccentrically disposed, it is designed to mate with cam ramp 19. Means for rotating are shown as at 22, with these rotation means comprising a hex socket arrangement as at 26 to which rotatable cam 24 is fixedly secured. Alternatively, a Phillips-head or blade-head arrangement may be utilized in lieu of the hex socket arrangement illustrated at 26.

Figure 10:
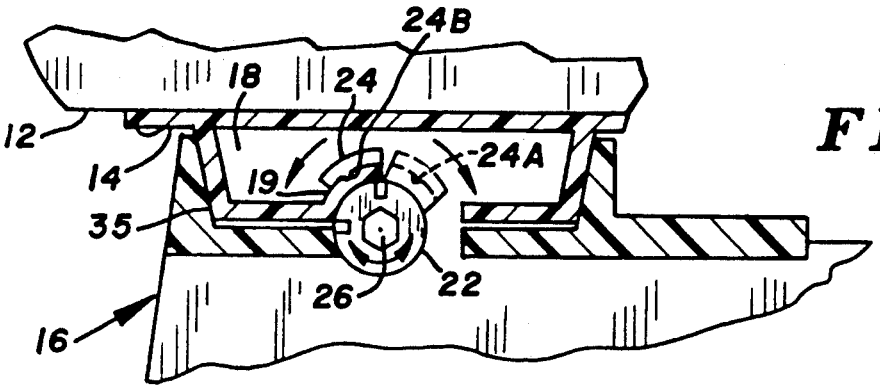
FIG. 10 is a vertical sectional view taken along the line and in the direction of the arrows 10—10 of FIG. 9.
Figure 11:
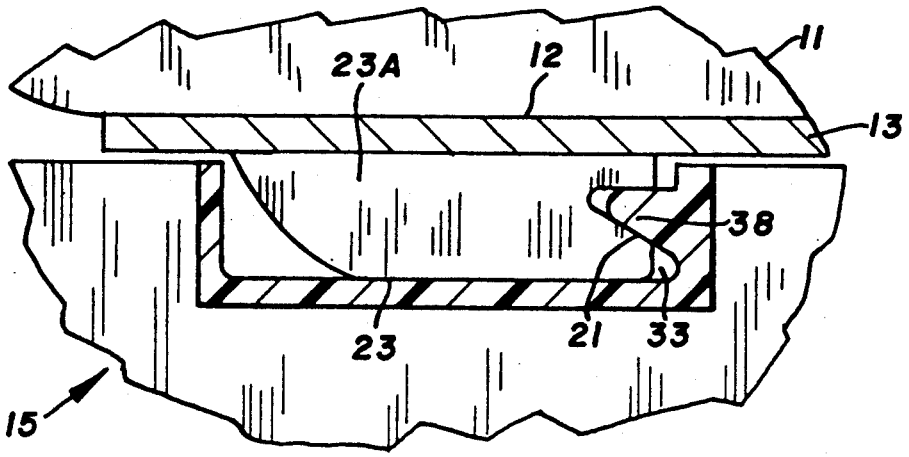
FIG. 11 is a view similar to FIG. 10, and illustrating the camming rail utilized in the toe portion of the assembly, and further illustrating the manner in which the wedged ramp portion of the wheel carrier is placed into engagement with the camming ramp.
Figure 12:
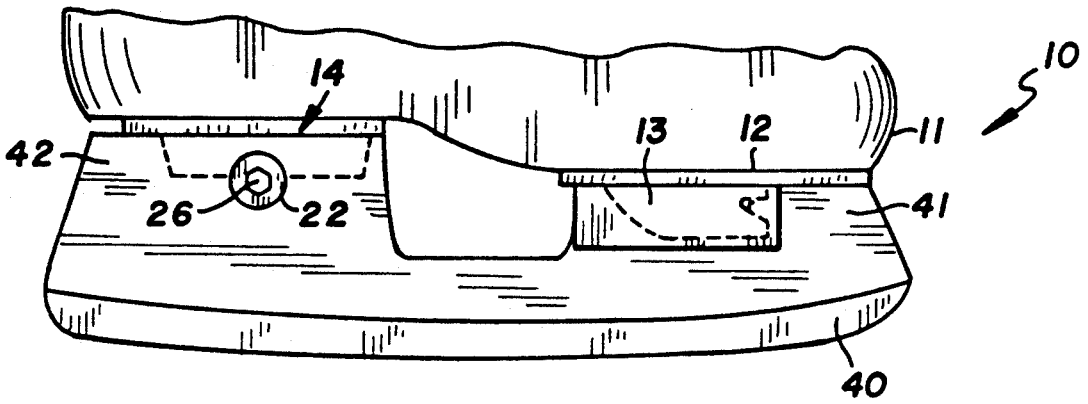
FIG. 12 is a partial side elevational view and illustrating an ice blade assembly being coupled to the shoe portion illustrated in FIGS. 1-11 hereinabove.

With continued attention being directed to FIG. 10 of the drawings, it will be observed that the surface of rotating cam 24 is provided with a small projection such as at 24A, with the projection 24A mating with a complementary groove 24B formed in cam holding surface 19.

In certain instances, it may be desirable to employ the rotatable cam attaching system for both toe and heel pieces. The combination arrangement illustrated in the embodiment of FIGS. 1-13, for example, also provides a desirable arrangement.

Figure 9:
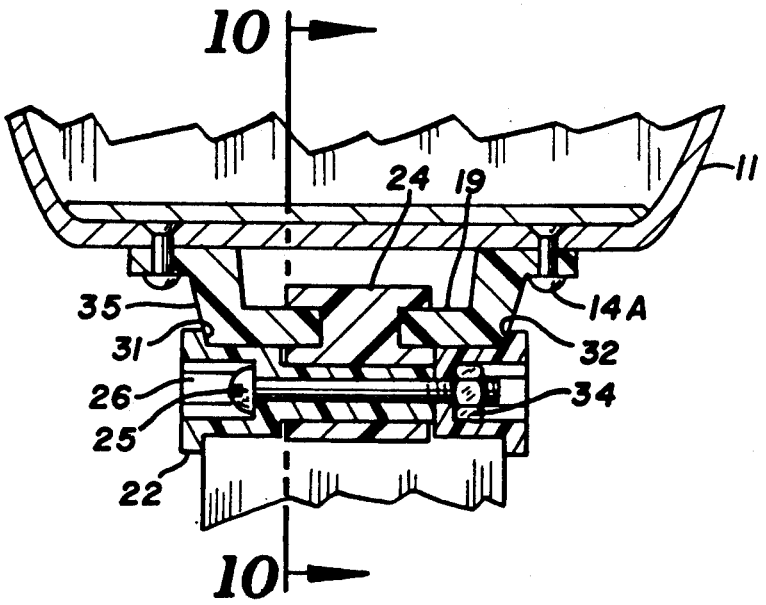
FIG. 9 is a vertical sectional view of the camming ramp attachment means utilized at the heel portion of the shoe, with FIG. 9 being taken along the line and in the direction of the arrows 9—9 of FIG. 1.

With continued attention being directed to FIGS. 5 and 6 of the drawings, the toe and heel attachment members each include a truncated pyramidal anchoring assembly as at 28 and 29, with the assembly being provided with inwardly tapering flange surfaces which define a contact zone for mating engagement with a complementary truncated pyramidal opening or concavity formed in the blade attachment means, such as illustrated at 31 and 32 in FIG. 9, and at 33 in FIG. 8.

Turning now to the corresponding coupling means which form a portion of the blade support subassembly, hex socket 26 is designed as a hex-shaped cam drive arrangement or member. The hex socket, as illustrated at 26, is designed to receive a hex drive key for achieving cam rotation and releasable assembly of surface blade support with the shoe. Coupling bolt 25 and nut 34 retains cam drive assembly in place, and, in turn, retains and controls the disposition of rotatable cam 24. A cam location reference mark may be employed, if desired, in order to alert the user to the relative dispositions of the cam 24 and its mating surface 19.

It will be observed that the toe and heel attachment pads are in the form of tapered flanged mounts, such as illustrated at 35 in FIGS. 3 and 5 and at 36 in FIG. 6. The toe and heel attachment pads each include tapered sides, with these tapered sides providing a tight wedge fit between the mating surfaces of the toe and heel attachment pads and the blade support subassembly member.

The camming rail or retaining notch provided at the forward end of the toe attachment is designed to rigidly hold and otherwise secure the complementary notch ramp projection 38 in place. Flat contact surface 23 of camming or retaining rail 23A is provided in order to accommodate a secure mating fit. In actual use and operation, the notch ramp projections 38 are initially engaged with the camming rails, and thereafter the heel portion is snugly set into place and camming ramp surface 24 is rotated into firm engagement with cam holding surface 19 to complete the attachment procedure. A similar attachment arrangement is utilized, of course, when either an in-line roller assembly or an ice blade is employed as the surface blade support. The surface blade support subassembly, as indicated, may be designed with an ice blade such as ice blade 40 (FIG. 12) or with in-line rollers secured in a frame as in FIGS. 1-11 and 13. The term "surface blade support subassembly" is designed to refer to either arrangement.

While the camming rail or retaining notch shown at the forward end of the toe attachment is illustrated with a pair of camming or retaining rails in place, such as camming rail 23A. In certain instances, for added durability and tightness of fit, three or more such camming rails may be employed.

In either the ice blade or in-line roller application, the blade support subassembly includes frame means having a surface contact member secured thereto. The attachment means in the ice skate model is shown at 41 and 42. As has been indicated, each of these assemblies is provided with an identical blade support anchoring cam ramp for rotatable mating contact with the corresponding cam ramp molded into the blade mount. Through this combination of components, firm cooperative mounting is achieved between the shoe and the toe and heel attachment pads. In this connection, it will be noted that the surface blade support subassembly includes such a frame means for ice blade model shown in FIG. 12, with the frame means having toe and heel pad receiving cavities formed therewithin. These arrangements are arranged to firmly receive and retain toe and heel attachment pads respectively in firmly but releasable disposition therewithin.

Figure 13:
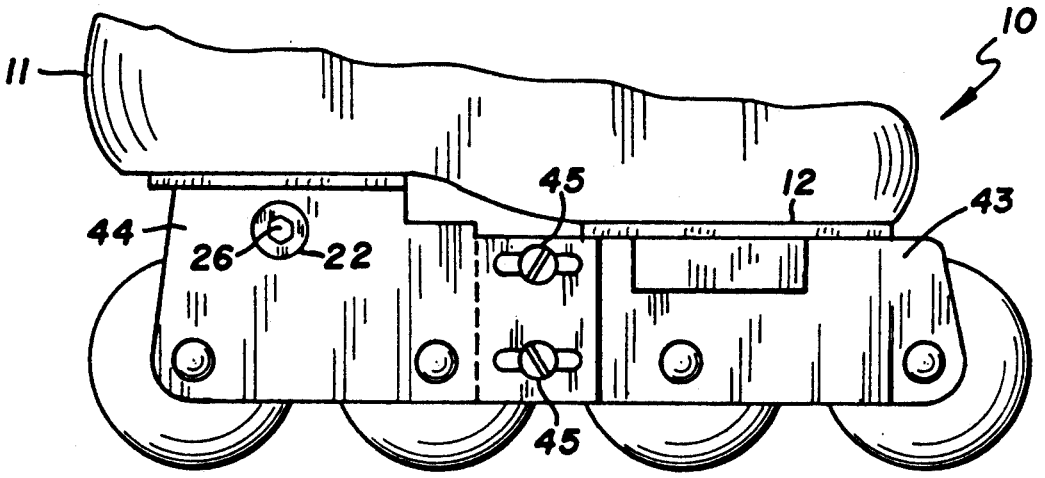
FIG. 13 is a partial side elevational view of a modified form of the assembly illustrated in FIG. 1, and showing one embodiment of an adjustable length feature of the in-line roller.

As indicated earlier, in-line roller frame may be made longitudinally adjustable, and one such means of facilitating this feature is to render the frame telescopically adjustable along its longitudinal axis. Such an arrangement is illustrated in FIG. 13, with the frame 38 being comprised of a forward segment 43 and a trailing segment 44, with through-bolts being provided as at 45—45 for joining segments 43 and 44 together, one to the other. Also, as indicated earlier, longitudinal adjustment of blade length may be achieved in this fashion, thereby making it possible for the user to employ a single blade with a variety or selection of shoe sizes. When longitudinally adjustable in a telescoping fashion, as illustrated in FIG. 13, complementary longitudinally disposed projections and cavities will be provided in order to retain longitudinal rigidity and stability.

The shoe 11 as described hereinabove is fabricated of stable and utilitarian material. Shoe 11, in the embodiment of FIG. 13, includes the conventional base portion and instep area as at 50, together with coupling or closure members 51—51 of the type conventionally utilized to capture and otherwise retain tongue 52 in position.

Figure 14:
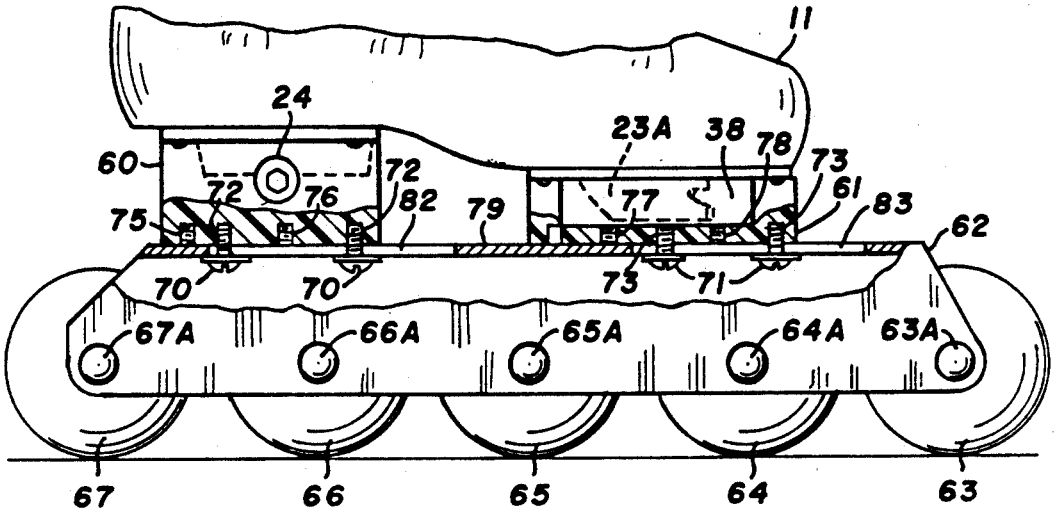
FIG. 14 is a side elevational view of a modified form of the assembly illustrated in FIG. 1, and showing a second embodiment of an adjustable length feature of the in-line roller.
Figure 16:
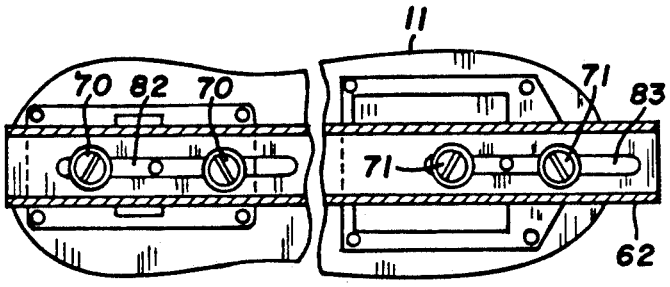
FIG. 16 is a fragmentary bottom plan view of the embodiment illustrated in FIGS. 14 and 15, and illustrating the toe and heel segments of the device illustrated in FIG. 14 with the center portion being broken away.
Figure 15:
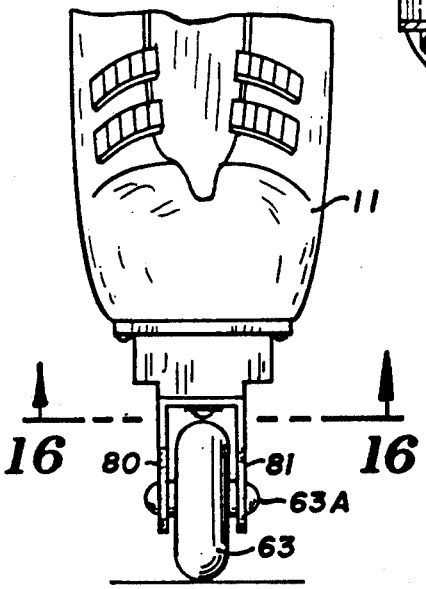
FIG. 15 is a partial front elevational view, partially broken away, illustrating the embodiment illustrated in FIG. 14.

Attention is now directed to the embodiment illustrated in FIGS. 14, 15 and 16 wherein shoe 11 equipped with coupling enclosure members 51—51 is illustrated. Shoe 11 in the embodiment of FIGS. 14–16 is essentially equivalent to that illustrated in the embodiments of FIGS. 1–13, with the exception of the incorporation of heel piece 60 and toe piece 61. Heel piece 60 and toe piece 61 are designed to receive and retain in place longitudinally adjustably positionable wheel frame 62 for wheel members 63, 64, 65, 66 and 67, each of which is journaled for rotation within the side walls of wheel frame 62 such as at 63A, 64A, 65A, 66A and 67A. In order to couple wheel frame 62 onto heel piece 60, screws 70—70 are employed, with toe piece 61 being utilized to accommodate screws 71—71.

With continued attention being directed to FIG. 14 and specific attention being directed to FIG. 16 of the drawings, attachment screws 70—70 and 71—71 are passed through bores such as at 72—72 and 73—73 respectively. A plurality of additional bores are arranged in spaced relationship along the center portion of wheel frame 62, such as at 75, 76, 77 and 78. Wheel frame 62 is in the form of a channel member with a base plate portion 79 and a pair of flange members 80 and 81 extending therefrom. In this arrangement, with the shoe or boot size increment being arranged in a predetermined hole sequence pattern, mounting screws may be utilized to secure a shoe such as shoe 11 onto wheel frame 62 with accommodations being made for different shoe sizes. In this fashion, a single wheel frame size may be employed to accommodate several different shoe sizes, and the attachment may be made appropriate for the user by varying the position of the mounting screws within the wheel frame. In the arrangement illustrated in FIG. 14, heel piece 60 and toe piece 61 arrange and provide an appropriate mounting plane for the attachment of wheel frame 62 to the boot.

As is indicated in FIGS. 14 and 16, slots may be provided as at 82 and 83 to provide for additional flexibility and/or adjustment in the mounting of wheel frame 62 onto the boot 11. Slots may also be utilized to selectively place mounting screws such as 70—70 and 71—71 so as to provide for longitudinal adjustment of the mounting position and/or point of wheel frame 62 relative to boot 11. Personal preferences of the user may be accommodated in this fashion.

As is apparent in the modification of FIGS. 14–16, the rotatable cam member 24 described hereinabove in connection with the embodiments of FIGS. 1–13 is employed. Furthermore, the toe attachment in the form of the camming rail arrangement described hereinabove is employed, such as is shown at the notched ramp projections 38 and complementary camming and/or retaining rails 23A. The flat contact surface 23 provides for strong, durable support.

It will be appreciated that those skilled in the art may depart from the detail of the apparatus illustrated herein without actually departing from the spirit and scope of the present invention.

What is claimed is:

1. In a skate assembly comprising a shoe having a sole plate, toe and heel attachment means secured to said sole plate, and coupling means for securing a wearer's surface blade support subassembly to said toe and heel attachment means; said skate assembly being further characterized in that:

(a) at least one of said toe and heel attachment means includes recessed blade receiving anchoring members with inwardly extending locking flanges defining a gap zone therebetween and adapted to receive a mating blade support rotatable anchoring cam therewithin;

(b) said blade support subassembly including frame means having a surface contact member secured thereto along the base surface thereof and a said rotatable blade support anchoring cam in opposed relationship to said surface contact member;

(c) said coupling means having attachment means receiving cavities formed therewithin and each cavity being arranged to firmly receive and retain one of said attachment means therewithin, said rotatable cam locking member being rotatable about a camming axis and with a radially extending web with laterally extending camming ramp flanges coupled to said web and being disposed radially outwardly of said camming axis; the arrangement being such that the outer surface of the camming ramp engages the inner surface of the ramp flanges, with said radially extending web passing between said inwardly extending locking flanges defining said cam ramp.

2. The skate assembly as defined in claim 1 being particularly characterized in that said rotatable cam is secured to a means for manual rotation of said cam and is rotatable therewith.

3. The skate assembly as defined in claim 1 being particularly characterized in that each of said toe and heel attachment means has inwardly tapered side walls, with each side wall tapering inwardly in a direction away from the sole plate, and wherein each of said coupling means has complementary tapered side wall formed on said receiving cavities, with the side walls of said cavities being formed with side walls similar to those of the toe and heel attachment pads, and having a substantially matching outwardly tapering configuration to snugly receive said inwardly tapered side walls.

4. The skate assembly as defined in claim 1 being particularly characterized in that said surface blade support subassembly includes an ice skating blade.

5. The skate assembly as defined in claim 1 wherein said surface blade support subassembly includes an in-line roller blade.

6. The skate assembly as defined in claim 1 being particularly characterized in that said toe and heel attachment means includes a camming rail with an inwardly inclined retaining notch formed therein, and wherein said means includes a notch engagement ramp for firm engagement with said retaining notch.

* * * * *

UNITED STATES PATENT AND TRADEMARK OFFICE

CERTIFICATE OF CORRECTION

PATENT NO. : 5,193,827

DATED : March 16, 1993

INVENTOR(S) : Scott B. Olson

It is certified that error appears in the above-identified patent and that said Letters Patent is hereby corrected as shown below:

Column 8, line 13, after "said" insert -- coupling --.

Signed and Sealed this

Twenty-third Day of November, 1993

*Attest:*

Bruce Lehman

BRUCE LEHMAN

*Attesting Officer*

*Commissioner of Patents and Trademarks*